US009260213B2

(12) United States Patent
Wilson et al.

(10) Patent No.: US 9,260,213 B2
(45) Date of Patent: Feb. 16, 2016

(54) PACKAGING SYSTEM

(75) Inventors: Nick Wilson, Chicago, IL (US); James Higley, Dyer, IN (US); Mark Burk, Highland, IN (US)

(73) Assignee: Morrison Container Handling Solutions, Inc., Glenwood, IL (US)

( * ) Notice: Subject to any disclaimer, the term of this patent is extended or adjusted under 35 U.S.C. 154(b) by 796 days.

(21) Appl. No.: 13/560,068

(22) Filed: Jul. 27, 2012

(65) Prior Publication Data

US 2014/0026523 A1 Jan. 30, 2014

(51) Int. Cl.

| | |
|---|---|
| ***B65B 13/00*** | (2006.01) |
| ***B65B 53/02*** | (2006.01) |
| ***B65B 27/04*** | (2006.01) |
| *B65D 71/08* | (2006.01) |

(52) U.S. Cl.

CPC ..... *B65B 53/02* (2013.01); *B65B 27/04* (2013.01); *B65D 71/08* (2013.01)

(58) Field of Classification Search

CPC ..... B65B 17/02; B65B 13/00; B65B 13/18; B65B 13/183

USPC ..... 53/152, 203, 147, 544, 158, 556, 557, 53/48.2, 398; 198/379

See application file for complete search history.

(56) References Cited

U.S. PATENT DOCUMENTS 1,085,673 A * 2/1914 Doldt ..... G07D 9/065 453/59
3,341,353 A * 9/1967 Johnson ..... B05D 1/18 118/416
3,523,052 A * 8/1970 Bolen ..... B29C 63/18 156/443
3,541,751 A * 11/1970 Quebe ..... B65B 17/02 198/376
3,648,821 A * 3/1972 Rudolph ..... B41F 17/14 198/378
3,802,942 A * 4/1974 Amberg ..... B31F 1/0054 156/196
3,901,180 A * 8/1975 Allen ..... B05C 19/02 118/421
3,959,065 A * 5/1976 Ashcroft ..... B29C 63/426 156/294
4,009,301 A * 2/1977 Heckman ..... B05B 13/0235 118/308
4,011,122 A * 3/1977 Ashcroft ..... B65B 53/06 156/294
4,013,496 A * 3/1977 Amberg ..... B26D 3/085 156/204
4,215,460 A * 8/1980 Amberg ..... B29C 63/423 156/86
4,248,030 A * 2/1981 Heckman ..... B65C 3/065 156/423
4,354,334 A * 10/1982 Hara ..... B65B 17/025 53/48.4
4,628,666 A * 12/1986 Lems ..... B65D 71/506 206/150

(Continued)

*Primary Examiner* — Gloria R Weeks

(74) *Attorney, Agent, or Firm* — Quinn Law Group, PLLC

(57) ABSTRACT

A packaging system and method forms a bundled group of articles in an oriented arrangement, by applying a wrapping material to the articles via the bottoms of the articles while the oriented arrangement of articles is inverted and retained by a pallet. The wrapping material may be a sleeve of shrinkable material applied to the inverted end of the articles and shrunk to conform to the articles and form a base enclosing the bottoms of the articles. The articles are retained by the pallet in the oriented arrangement during the inverting, sleeving and bundling of the group of articles, to provide a bundled group including the articles securely contained by the shrunk wrapping in the oriented arrangement. The bundled group may include more than one type of article. The pallet may be configured to retain a top portion of the article, which may have an irregular or asymmetrical shape.

15 Claims, 5 Drawing Sheets

(56) References Cited

U.S. PATENT DOCUMENTS 5,154,039 A * 10/1992 de Guglielmo ..... B65B 11/105 493/387
5,454,212 A * 10/1995 Tanaka ..... B65B 5/10 53/252
6,196,788 B1 * 3/2001 Talbot ..... B65G 47/088 198/418.6
6,868,652 B2 * 3/2005 Arends ..... B65B 21/04 198/376
7,131,252 B2 * 11/2006 Otsuka ..... B65B 5/067 53/201
7,574,843 B2 * 8/2009 Koster ..... B65B 21/245 53/158
7,980,046 B2 * 7/2011 Yousefpour ..... B08B 3/02 53/167
8,407,973 B2 * 4/2013 Finkowski ..... A21C 9/086 53/247
2004/0020167 A1 * 2/2004 Bertuzzi ..... B65B 5/10 53/446
2004/0163362 A1 * 8/2004 Otsuka ..... B65B 5/067 53/512
2006/0263494 A1 * 11/2006 Geng ..... A21D 6/001 426/128
2009/0056276 A1 * 3/2009 Yohe ..... B65B 9/02 53/398
2010/0058716 A1 * 3/2010 Leykamm ..... B65B 21/245 53/446
2011/0061339 A1 * 3/2011 Hartness ..... B29C 66/432 53/203
2012/0151879 A1 * 6/2012 Ghezzi ..... B65B 11/025 53/448

* cited by examiner

PACKAGING SYSTEM

TECHNICAL FIELD

The present invention relates to packaging a group of articles using a shrinkable wrapping material.

BACKGROUND

Groups of articles, such as containers, may be packaged by sleeving the each group of articles with a sleeve made of a shrinkable wrapping material as the articles are transported on a conveyor. In typical practice, the sleeve is applied to the group of articles with the articles nested together in an upright position, where the sleeve is applied over the top portions of the upright nested articles, and the material of the sleeve is shrunk to bundle the group of nested articles. Where it is desired to bundle the group by wrapping a portion of the sleeve around the bottom of the group of nested articles, for example, to form a base around the nested group, the group of articles is typically elevated on a pedestal or other fixture having a surface area smaller than the perimeter area of the bottom of the nested group, to allow positioning of the sleeve such that a portion of the wrapping material can be shrunk to form a base around the perimeter of the bottom of the group of nested articles. The pedestal must have a surface area sufficient to support the group of nested articles during the sleeving process, which may limit the width of the area of the bottom perimeter of the nested articles extending beyond the pedestal and exposed to be enclosed by the wrapping material to form the base of the bundled group.

Alternatively, the group of nested articles may be positioned in or on a box, a boot, or holder, a packing sheet, a tray or other supportive element, such that the supportive element is positioned on the pedestal to support the group of nested articles and the supportive element and group of nested elements are both sleeved and shrunk wrapped together to form the bundled group. The supportive element, which may be made of a paper-based material, stabilizes the nested articles and when shrunk wrapped around the bottom during the bundling process, provides a base for the bundled group. This approach consumes additional packaging material by using a supportive element in addition to the wrapping material and is less amenable to recycling by combining polymer and paper elements in the packaging which must be separated for recycling prior to disposal. The cost of this approach is increased by the cost of the additional packaging material, and the increased time and additional equipment required to position the group of nested articles in or on the supportive element prior to sleeving and shrink wrapping. The holder or supportive element may also increase the weight and footprint of the bundled group, increasing shipping and transportation costs and decreasing shelf density during storage or display of the bundled groups.

Unconstrained or minimally constrained movement and/or vibration of the nested articles as they are transported on the conveyor to be grouped for sleeving may result in misorientation of one article relative to another, sub-optimized nesting densities, and/or instability of the articles in the bundled group. Misoriented articles, especially those having irregular shapes or non-symmetrical head portions may interfere with each other reducing pack density and/or bundle stability, or may interfere with sleeving of the nested group, for example, by protruding outside the base footprint of the nested group, creating a non-uniform or misaligned appearance or affecting perceived packaging quality. Dedicated fixturing and/or equipment to position and retain the irregular shaped portions of the upright articles in an oriented arrangement during the conveying, grouping, sleeving and bundling process may reduce packaging line flexibility and/or may be cost prohibitive.

SUMMARY

A system and method for bundling a plurality of articles to form a bundled group is provided. The system includes a pallet configured to be actuated from an unlocked to a locked condition and from the locked to an unlocked condition. In the unlocked condition, the pallet is configured to receive an oriented group of articles, where the oriented group is defined by an oriented arrangement of the plurality of articles relative to each other. In the locked condition, the pallet is configured to retain the oriented group in or to the pallet such that the plurality of articles remains positioned in the oriented arrangement during the bundling process. The pallet is further configured to invert the oriented group to an inverted position prior to presenting the oriented group in the inverted position for bundling.

The plurality of articles is bundled by applying a wrapping material, which may be a shrinkable wrapping material, to the plurality of articles via an inverted end of the oriented group to form a bundled group, e.g., such that the wrapping material is passed over the bottoms of the articles during application of the wrapping material to the oriented grouping. In one example, the wrapping material is configured as a sleeve which is applied to the oriented grouping by sliding the sleeve onto the inverted end of the oriented arrangement of articles, e.g., over the bottoms of the articles forming the inverted oriented arrangement, and positioned such that a portion of the sleeve surrounds the arranged articles and a portion of the sleeve extends from the inverted end, e.g., from the bottoms of the articles. The wrapping material is shrunk to conform to the oriented arrangement of articles and to form a base for the bundled group. The base portion of the shrunk wrapping material encloses and/or contains the bottoms of the plurality of articles forming the bundled group. During the process of inverting, wrapping and bundling, the plurality of articles is continuously retained in the oriented arrangement by the pallet, such that the bundled group formed by the system and method described herein is characterized by the plurality of articles retained in the oriented arrangement by the applied wrapping material.

The base portion formed of the shrunk wrapping material is configured to sufficiently support and enclose the bottoms of the articles in the bundled group, such that the need to insert or include a separate supportive element such as a boot, tray, or sheet liner into the bundled group to stabilize or contain the bottoms of the articles in the bundled group is obviated. Using a single type of wrapping material to package the bundled group, which may be a recyclable material, simplifies and facilitates disposal and recycling of the packaging material. By retaining the articles in an oriented arrangement in the pallet during wrapping and bundling to form the bundled group, the articles maintain the oriented arrangement in the bundled group, providing advantages which may include uniformity and quality of appearance of the oriented articles in the bundled group, alignment of irregular portions of the articles to minimize packaging space and packaging footprint, optimized shelf density, product placement of one article relative to another article within the bundle for marketing, product identification or display purposes, etc.

The above features and other features and advantages of the present invention are readily apparent from the following detailed description of the best modes for carrying out the invention when taken in connection with the accompanying drawings.

DETAILED DESCRIPTION

Figure 1:
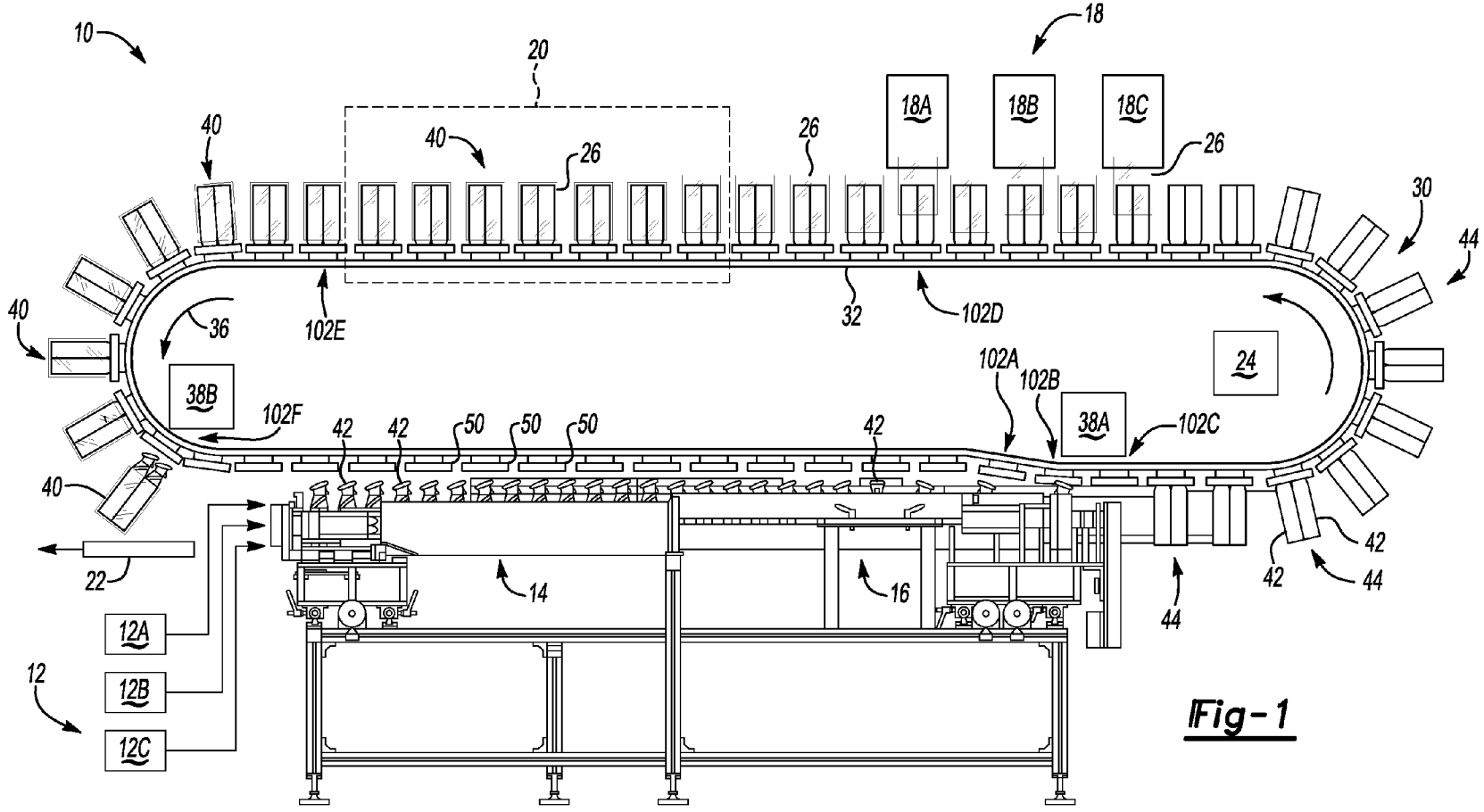
FIG. 1 is a schematic side view illustration of a packaging system for grouping a plurality of articles and bundling the group using a wrapping material.

Referring to the drawings, wherein like reference numbers correspond to like or similar components throughout the several figures, there is shown in FIG. 1 a packaging system generally indicated at 10 and configured to provide and bundle an oriented group 44 comprising a plurality of articles 42. A method of packaging the oriented group 44 by applying a shrinkable wrapping material 26 to the oriented group 44 in an inverted position is illustrated in FIGS. 2A-2F. The shrinkable wrapping material 26 may be a polyolefin (POF) or polyvinyl chloride (PVC) based material, or may comprise other shrinkable polymeric materials which are known. The method includes using the system 10 to collate the plurality of articles 42 and orient the plurality of articles 42 in an oriented arrangement to provide an oriented group 44. The oriented group 44 is retained in the oriented arrangement by a pallet 50, and inverted during transport of the oriented group 44 to a wrapping apparatus generally indicated at 18. The inverted oriented group 44 is presented to the wrapping apparatus 18 which applies a wrapping material 26 to the inverted oriented group 44. The wrapping material 26 is received onto the inverted, e.g., bottom portion or bottom end of the oriented group 44 such that a portion 90 of the wrapping material 26 extends upward from the bottom or inverted end of the inverted oriented group 44. As used herein, the term "bottom" when referring to the bottom of the oriented group 44, to the bottom of the bundled group 40, and/or to the bottom of an article 42, refers to the surface or portion of the respective group 40, 44 and article 42 which would be downward facing or in a lowermost position relative to the remainder of the group 40, 44 or article 42 when the group 44, 44 or article 42 is positioned upright, e.g., with the head portion of the article or articles 42 in an upward facing or uppermost position. The upright position would also be understood as the typical position the article 42 would be placed when placing the article 42 at rest on a surface of a display shelf or for storage. An article 42, an oriented group 44, and/or a bundled group 40 is "inverted," as that term is used herein, when the article 42 or plurality of articles 42 forming the group 40, 44 are oriented such that the bottom(s) 28 of the article 42 or plurality of articles 42 forming the group 40, 44 are in an upward facing or uppermost position relative to the remainder of the article 42, e.g., such that the head portion of the inverted article 42 is positioned below or downward facing relative to the bottom 28 of the inverted article 42. Further, an article 42 may be considered to be presented in an inverted orientation relative to a wrapping apparatus 18 when the article is oriented with the bottom 28 presented to and/or facing the wrapping apparatus 18, such that the wrapping material, which in the example shown is configured as a sleeve 26, is received onto the inverted article 42 via the bottom 28, as generally indicated at 102D of FIG. 1.

The system is further configured to shrink the wrapping material 26 around the oriented group 44 to form a bundled group 40, wherein the bundled group 40 is characterized by the plurality of articles 42 securely packaged in the oriented arrangement by the shrunk wrapping material 26. The wrapping material 26, which in the example shown is configured as a sleeve, is positioned relative to the oriented group 44 with a portion of the sleeve 26 extending from the bottom of the oriented group 44, as shown in FIGS. 1 and 2, such that after shrinking, the extended portion is shrunk to define a base portion 90 of the bundled group 40. The base portion 90 is configured to sufficiently support and enclose the bottom surfaces 28 of the articles 42 in the bundled group 40, such that the need to insert or include a separate supportive element such as a boot, box, tray, sheet, liner, holder in the bundled group 40 to stabilize or contain the bottom surfaces 28 of the articles 42 in the bundled group 40 is obviated. Using a single wrapping material 26 to package the bundled group 40 simplifies and facilitates recycling of the packaging material during disposal thereof. By retaining the articles 42 in an oriented arrangement in the pallet 50 during wrapping and bundling to form the bundled group 40, the articles 42 maintain the oriented arrangement after packaging to form the bundled group 40, providing advantages which may include uniformity and quality of appearance of the oriented articles 42 in the bundled group 40, alignment of irregular portions of the articles 42 to minimize packaging space and packaging footprint, optimized shelf density, etc.

In one example, the plurality of articles 42 forming the oriented group 44 and packaged to form the bundled group 40 may be substantially the same, e.g., may all be of the same type of articles 42. In another example, the plurality of articles 42 forming the oriented group 44 and packaged to form the bundled group 40 may include at least one article 42 of a type different from the type of another of the articles 42 included in the bundled group 40. For example, a first type of article 42A, a second type of article 42B and a third type of article 42C may be included in an oriented group 44, as shown in the examples of FIGS. 4B and 5B, wherein the first, second and third types of articles 42A, 42B, 42C differ from one another in at least one identifying characteristic.

As used herein, the term "identifying characteristic" is broadly defined to include any characteristic of one type of article 42 which may be used to identify the one type of article 42 as being of a different type than another type of article 42. By way of non-limiting example, an "identifying characteristic" of an article 42 may be an appearance characteristic including one of a shape, size, color or combination of colors, finish, texture, pattern, or graphical characteristic, or a combination of these displayed by or defining the article 42. An appearance-related "identifying characteristic" may include a graphical or textual descriptor of the article 42, which may include, by way of non-limiting example, a descriptor of one or more of a manufacturer, a brand, a logo, a flavor, a category, a classification, a function, name or any description or other graphical element displayed on or embodied by the article 42 including text, images, patterns, illustrations, textures, etc. which identifies the type of article 42 as different from another type of article 42. An "identifying characteristic" of an article 42 may be a physical characteristic such as a functional feature, for example, a dispensing feature, a sealing feature, or other functional element or feature, a forming or assembly characteristic, a textural element, a material from which the article is made, etc.

An article 42 may be configured as any shape or type of article which may be bundled during packaging using the system 10. For example, an article 42 may be a container or canister used for packaging a dispensable product including liquid, gas, solid and semi-solid dispensable products. A head or top portion 48 of the article 42 may be configured for dispensing the contents of the article 42 while operatively and/or sealably attached to a neck portion 46 of the article 42. For example, the head portion 48 may be configured for one of aerosol dispensing, non-aerosol dispensing, or pump dispensing of the contents of the article 42 and may include one or more dispensing elements (not shown) including but not limited to a nozzle, dispensing trigger, tab or button, etc. as may be used in dispensing the contents (not shown) of the article 42. The head portion 48 may be selectively attached to the neck portion 46 and selectively removable from the neck portion 46 to access the contents of the article 42, where the neck portion 46 may be configured to dispense the contents of the article 42.

In another example, an article 42 may be a non-dispensing article, a consumer good, an industrial product, etc. Generally, an article 42 may be any article which may be retained by a pallet 50 configured to retain that type or configuration of the subject article 42 in an inverted position and oriented with respect to the other articles 42 of the plurality of articles 42 forming the oriented group 44, where the subject article 42 may be of a type other than the type or types of the other articles 42 forming the oriented group 44, during transport, sleeving, and bundling of the oriented group 44 to form a bundled group 40.

Each different type of articles 42A, 42B, 42C may be included in the oriented group 44 in differing quantities. For example, FIG. 5B shows an oriented group 44C containing a total of four articles 42, including two of a first type of article 42A, and one each of a second and third type of article 42B, 42C. Different types of articles 42 included in an oriented group 44 may include two or more articles 42 of different shapes, sizes, heights, etc. (not shown for clarity of illustration), wherein the pallet 50 may be configured to retain one type of article of a first shape or size in an oriented arrangement relative to another type of article of a second shape or size in the oriented group 40 such that the bottoms 28 of each of the different types of articles 42 are substantially aligned, e.g., substantially co-planar, to facilitate formation of the base portion 90 during the bundling process described herein, and such that the base portion 90 and the bottoms 28 of the plurality of containers forming the bundled group 40 collectively define a generally flat plane to support and stabilize the bundled group 40 when the bundled group 40 is positioned in a generally upright position, for example, during placement of the bundled group 40 on a shelf for display or storage. The base portion 90 may also be referred to herein as the base 90.

In the example shown in FIGS. 1-5B, the articles 42 are shown configured as dispensing containers including an irregularly or non-symmetrically shaped head portion 48. The example of a dispensing container is non-limiting. The system 10 and method described herein may be used to package an oriented group 44 of articles 42, wherein the oriented group 44 may include two or more articles 42.

Referring again to FIG. 1, the system 10 may include an infeed mechanism generally indicated at 12 and configured to feed a quantity and/or mix of one or more types of articles 42 required to form a bundled group 40 to a collator generally indicated at 14. The infeed mechanism 12 may include one or more feeding mechanisms 12A, 12B, 12C each configured to feed articles 42 to the collator 14. For example, the infeed mechanisms 12A, 12B, 12C may each be configured as a conveyor, feed line or other transfer mechanism to provide articles 42 to the collator 13 in the quantity, order and mix required to form a bundled group 40.

The collator 14 is configured to arrange the articles 42 received from the infeed mechanism 12 into grouping order as required to form the bundled group 40 and to convey the articles 42 in grouping order to an orientor generally indicated at 16. The orientor 16 is configured to receive the articles 42 in grouping order, and to guide, align or otherwise manipulate a plurality of the articles 42 into an oriented arrangement to provide an oriented group 44 for presentation to one of a plurality of pallets 50 operatively connected to a pallet conveyor 32 of a pallet line generally indicated at 30. The oriented group 44 is presented to a pallet 50 with the plurality of articles 42 in a generally upright position relative to the pallet 50, such that the top portion 48 (see FIGS. 2A-2B) of each of the plurality of articles 42 is received into a recess 76 defined by the pallet 50.

The pallet line 30 includes a drive mechanism 24 in operative communication with the pallet conveyor 32 and configured to drive the pallet conveyor 32 in a direction 36, thus moving the pallets 50 in the direction 36. Movement of the pallet conveyer 32 and operation of the orientor 16 is coordinated such that an oriented group 44 of articles 42 is presented to each of the pallets 50 as each pallet 50 approaches a locking mechanism 38A. The pallet 50 is unlocked, e.g., in an open condition as shown in FIG. 2A, as the pallet 50 approaches the locking mechanism 38A (generally indicated at 102A in FIG. 1), and is configured, as will be described in additional detail herein related to FIGS. 2A-2F, to receive the oriented group 44 of articles 42 as shown in FIG. 2B and generally indicated at 102B in FIG. 1.

Figures 2A, 2B, 2C:
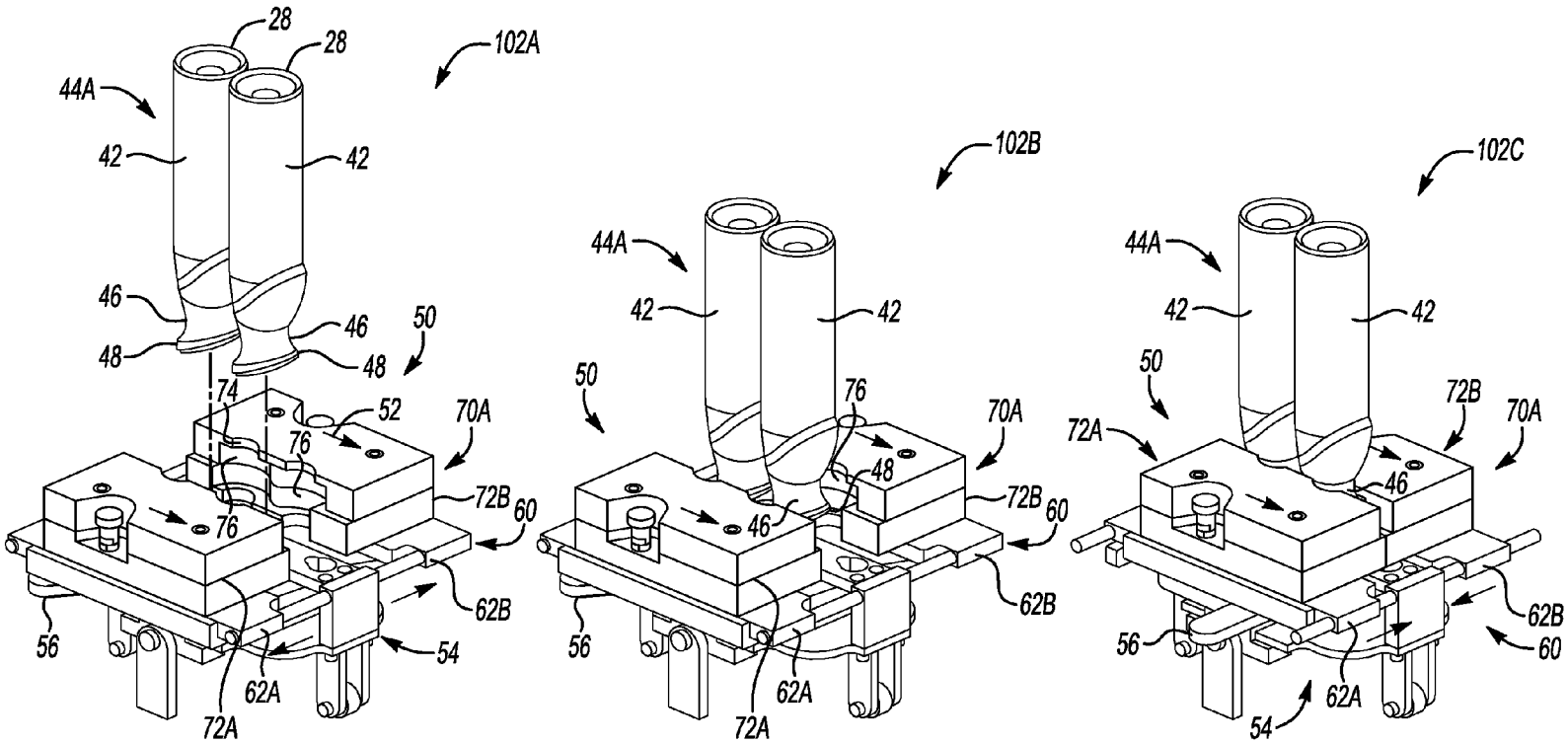
FIG. 2A is a perspective illustration of a pallet of the system of FIG. 1 in an open or unlocked position.
FIG. 2B is a perspective illustration of the pallet of FIG. 2A receiving an oriented group of articles.
FIG. 2C is a perspective illustration of the pallet of FIG. 2A in a closed or locked position to retain the oriented group of articles in an oriented arrangement.
Figure 2F:
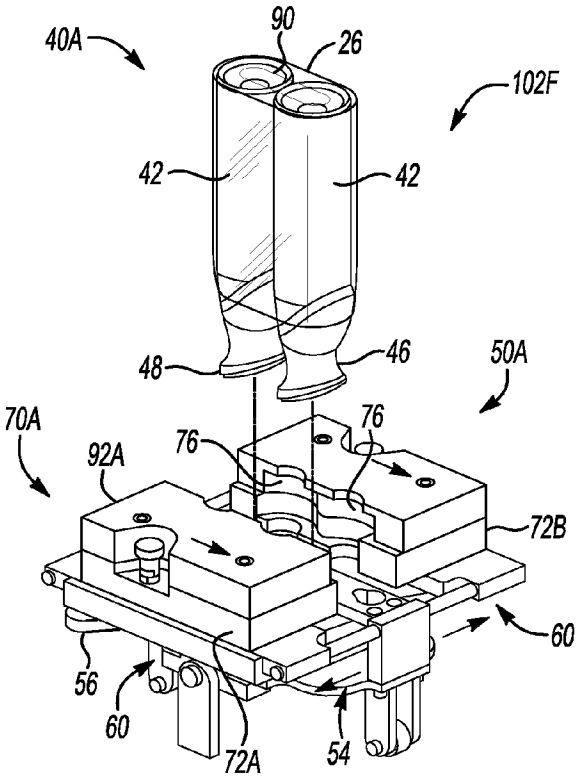
FIG. 2F is a perspective illustration of the pallet of FIG. 2A in an unlocked position showing the bundled group of articles being released from the pallet.
Figure 2E:
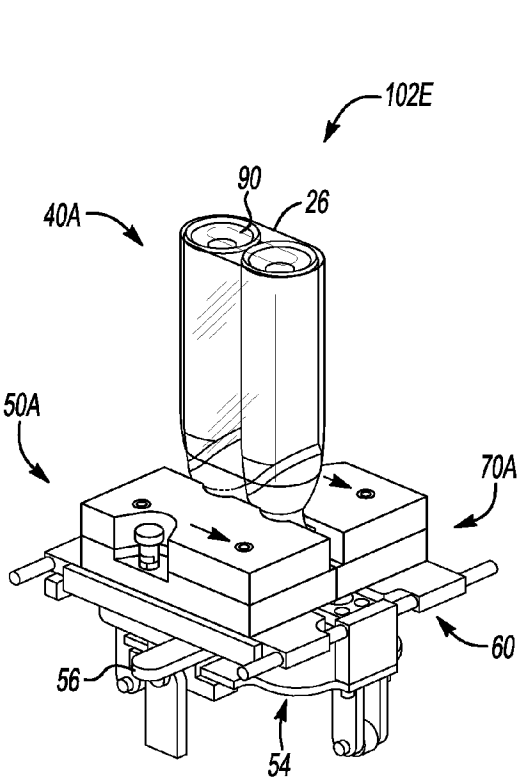
FIG. 2E is a perspective illustration of the pallet of FIG. 2A showing the oriented group after shrinking the wrapping material to bundle the articles into a bundled group.
Figure 2D:
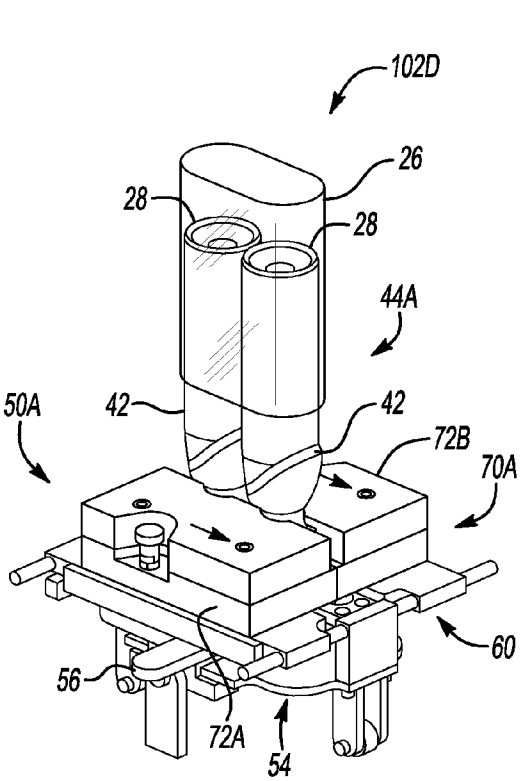
FIG. 2D is a perspective illustration of the pallet of FIG. 2A presenting the oriented group in an inverted position for sleeving with a wrapping material.

As coordinated movement of the pallet 50 by the pallet conveyor 32 and conveyance of the oriented group 44 of articles 42 by the orientor 16 continues in the direction 36, the pallet 50 is conveyed into operative communication with the locking mechanism 38A, such that the locking mechanism 38A actuates an actuating mechanism (generally indicated at 80 in FIG. 3C) of the pallet 50 to lock the pallet 50 in a closed position as shown in FIG. 2C and generally indicated at 102C in FIG. 1. Actuation of the pallet 50 from the open position shown in FIG. 2A to the closed position shown in FIG. 2C causes the articles 42 of the oriented group 44 to be retained in the oriented arrangement in which the articles 42 were presented to the open pallet 50 by the orientor 16. Movement of the pallet conveyor 32 and the pallet 50 including the retained oriented group 44 continues in the direction 36. The pallet line 30 and/or the pallet conveyor 32 are configured such that as the pallet 50 is conveyed toward the wrapping apparatus 18, the pallet 50 is reoriented relative to the wrapping apparatus 18 to invert the oriented group 44 retained by the pallet 50 relative to the wrapping apparatus 18 and prior to being presented to the wrapping apparatus 18. In the inverted position as shown generally at 102D in FIG. 1, the bottoms 28 of the articles 42 included in the oriented group 44 are presented to the wrapping apparatus 18 to receive wrapping material 26 configured as a sleeve and applied by the wrapping apparatus 18 to the oriented group 44. As shown in FIGS. 1 and 2D, the sleeve of wrapping material 26 is applied to, e.g., positioned on, the oriented group 44, which in FIG. 2D is configured as an oriented group 44A including two articles 42, and is received via the bottoms 28 of the grouped articles 42. The sleeve of wrapping material 26 is positioned to generally surround the oriented group 44 and to extend beyond the bottoms 28 of the articles 42, as shown in FIG. 2D.

The pallet 50 with the oriented group 44 retained by the pallet 50 in the oriented arrangement and with the sleeve of wrapping material 26 positioned on the oriented group 44 as shown in FIG. 2C is conveyed to a shrink apparatus generally indicated at 20, where the shrink apparatus 20 is configured to shrink the shrinkable wrapping material 26 to securely bundle the plurality of articles 42 of the oriented group 44 together in the oriented arrangement. In one example, the shrinking apparatus 20 may be configured as a shrink tunnel which may provide an atmosphere having an elevated temperature and/or may direct a flow of heated air or steam at the wrapping material 26 to cause the wrapping material of the sleeve 26 to shrink into a shape conforming to and enclosing the oriented group 44 of articles 42. The portion of the sleeve 26 extending beyond the bottoms 28 of the articles 42 may be shrunk to form a base 90, wherein the base 90 encloses the bottoms 28 to securely retain the articles 42 in the bundled group 40 shown generally at 102E in FIG. 1 and in FIGS. 2E and 2F. The base 90 may be configured to enclose a substantial portion of the bottoms 28, where the strength of the base 90 to retain the articles 42 in the bundled group 40 and/or to prevent shifting, movement or misorientation of the articles 42 relative to each other in the bundled group 40 may be proportional to the percentage of the co-planar area defined by the bottoms 28 of the plurality of articles 42 enclosed by the base 90 formed of the shrunk wrapping material 26. In one example, the sleeve of the wrapping material 26 may be positioned and/or configured such that after shrinking the wrapping material 26, the base 90 formed of the shrunk wrapping material 26 encloses and/or covers at least 25% of the co-planar area defined by the plurality of bottoms 28. In another example, the base 90 encloses and/or covers at least 40% of the co-planar area defined by the plurality of bottoms 28, In a third example, as may be approximated from the example shown in FIGS. 2E and 2F, the base 90 encloses and/or covers more than 50% of the co-planar area defined the plurality of bottoms 28.

After the wrapping material 26 is shrunk to enclose, stabilize and package the oriented group 44 (see oriented group 44A in FIG. 2D, for example) to form a bundled group 40 (see bundled group 40A in FIGS. 2E and 2F, for example), the bundled group 40 retained by the pallet 50 is conveyed by movement of the pallet conveyor 32 in a direction 36 to move the pallet 50 into operative communication with the locking mechanism 38B. The locking mechanism 38B activates an actuating mechanism (generally indicated at 80 in FIG. 3C) of the pallet 50 to unlock the pallet 50 to an open position as shown in FIG. 2F and generally indicated at 102F in FIG. 1. Actuation of the pallet 50 from the closed position shown in FIG. 2E to the open position shown in FIG. 2F releases the head portions 48 of the articles 42 now secured in the bundled group 40 by the shrunk wrapping material 26 including the base 90, thereby releasing the bundled group 40 from the pallet 50. The released bundled group 40 is received by an offload mechanism 22, which may be configured to convey the bundled group 40 away from the pallet line 30. The bundled groups 40 formed by the system 10 may be conveyed via the offload mechanism 22 for additional processing, which may include, for example and not shown, automatically conveying, collating, palletizing and/or over packing the bundled groups 40 into multi-packs, wherein each multi-pack may include a plurality of the bundled groups 40.

One or more central processing units (CPU) and/or controllers (not shown) may be in operative communication with the system 10 or elements thereof such as the infeed mechanism 12, collator 14, orientor 16, locking mechanisms 38A, 38B, sleeving apparatus 18, film shrinking apparatus 20, to coordinate and control the movements functions, and/or operations of the respective elements of the system 10 that are required by the method of forming a bundled group 40 as described herein.

A method for forming the bundled group 40 is illustrated by the steps 102A-102F shown in FIGS. 2A-2F and generally indicated in FIG. 1. FIGS. 2A-2F and FIGS. 3A-3C further illustrate the pallet 50, which may include, in the example configuration shown, a chassis generally indicated at 54, a platen apparatus generally indicated at 60, and a jaw apparatus 70A configured to correspond to an oriented arrangement of the plurality of articles 42 comprising an oriented group 44. In the example shown in FIGS. 2A-3C, the jaw apparatus generally indicated at 70A is configured to correspond with the oriented group 44A, such that the jaw apparatus 70A in an open position shown in FIG. 2A, which may also be referred to as an unlocked condition, is configured to receive the plurality of articles 42 arranged to define the oriented group 44A as shown in FIG. 2B. The jaw apparatus 70A in a closed position shown in FIG. 2C, which may also be referred to as a locked condition, grips the oriented group 44A such that the plurality of articles 42 forming the oriented group 44A are continuously retained in the oriented arrangement in which they were provided to the pallet 50 from the orientor 16 during wrapping and bundling of the oriented group 44A to form the bundled group 40A.

In a step of the method indicated generally at 102A and shown in FIGS. 1 and 2A, an oriented group 44A comprising a plurality of articles 42 is conveyed to the pallet 50 with the jaw apparatus 70A in an open position. Continued movement of the oriented group 44A by the orientor 16 (see FIG. 1) and movement of the pallet 50 by the pallet conveyor 32 (see FIG. 1) is coordinated in the direction 36 shown in FIG. 1 such that at step 102B shown in FIG. 2B the oriented group 44A is received into a recess 76 defined by the jaw apparatus 70A and the actuating mechanism 80 (see FIG. 3C) is actuated as the pallet 50 moves in communication with the locking apparatus 38A (see FIG. 1) to actuate movement of the jaw apparatus 70A from the open position to the closed position shown in FIG. 2C. At step 102C shown in FIG. 2C, the oriented group 44A retained in the pallet 50 and moved by the pallet conveyor 32 for presentation to the sleeving apparatus 18. The pallet conveyor 32 is configured such that the pallet 50 and the oriented group 44A is inverted during movement of the pallet 50 toward the sleeving apparatus 18, and the oriented group 44A is presented in an inverted position to the sleeving apparatus 18 to receive a sleeve of wrapping material 26 applied to the bottoms 28 of the articles 42 of the oriented group 44A retained in the pallet 50.

The sleeving apparatus 18 may include one or more sleeving mechanisms 18A, 18B, 18C as required to accommodate the rate of flow of the pallets 50 and the oriented groups 44A through the sleeving apparatus 18, as required by the line rate of the pallet line 30. At step 102D shown in FIGS. 1 and 2D, the sleeving apparatus applies a sleeve of shrinkable wrapping material 26 to the oriented group 44A such that the leading portion of the sleeve 26 is positioned to surround the oriented group 44A with the trailing portion of the sleeve 26 extending upward from and beyond the bottoms 28 of the articles 42 of the oriented group 42, as shown in FIGS. 1 and 2D. As step 102E shown in FIGS. 1 and 2E, the pallet 50 retaining the oriented group 44A with the sleeve 26 applied thereto is conveyed through the bundling apparatus 20, which may be, for example, a shrink tunnel configured to expose the oriented group 44A with the applied sleeve 26 to an elevated temperature, where the elevated temperature may be provided by heated air circulated in the shrink tunnel 20 and/or directed at the applied sleeve 26. The applied sleeve 26, when exposed to the elevated temperature and/or heated air, shrinks to substantially conform with the outside surfaces of the oriented group 44A contacted by the shrunk sleeve 26, and to form a base 90, where the base 90 is substantially co-planar with a plane defined by the bottoms 28 of the plurality of articles 42 of the oriented group 44A. The sleeve 26 in the shrunken condition shown in FIG. 2E, bundles, contains and stabilizes the plurality of containers 42 in the oriented arrangement as retained by the pallet 50, to form a bundled group 40A.

In step 102F shown in FIGS. 1 and 2F, the pallet 50 retaining the bundled group 40A is moved in the direction 36 by the pallet conveyor 32 to move the actuating mechanism 80 and the pallet 50 in communication with the locking apparatus 38B (see FIG. 1), to actuate movement of the jaw apparatus 70A from the closed position to the open position shown in FIG. 2F. At step 102F shown in FIG. 2F, the bundled group 40A is released from the jaw apparatus 70A to an offload mechanism 22 for removal from the pallet line 30. The process cycle is repeated beginning with conveying the emptied pallet 50 in an unlocked condition from the locking mechanism 38B in coordination with operation of the orientor 16 toward the locking mechanism 38A to receive a subsequent oriented group 44 provided by the orientor 16.

As previously described, the method of forming a bundled group 40 may include collating the plurality of articles 42 using a collator 14 to provide the plurality of articles 42 in grouped order and in the required quantity and mix of types to the orientor 16 for manipulation by the orientor 16 into an oriented group 44, and conveyance and presentation to the pallet 50.

Figure 3A:
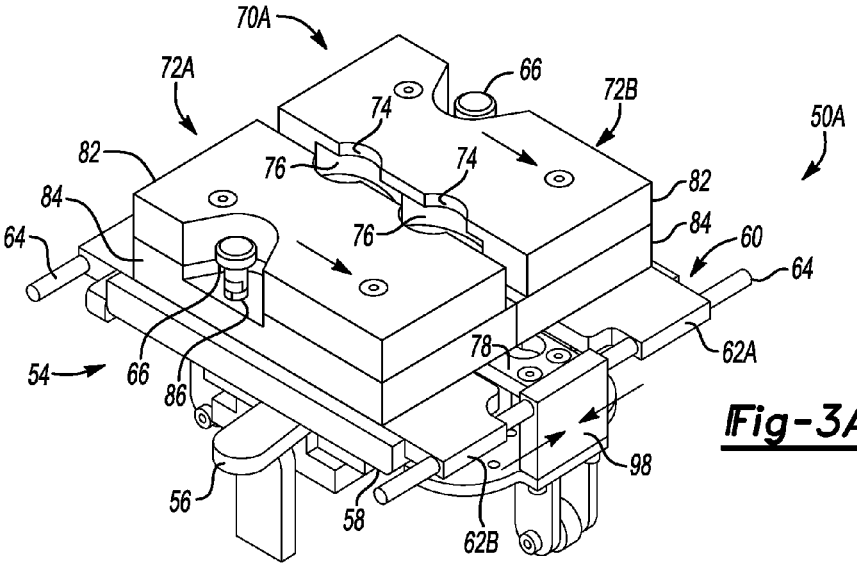
FIG. 3A is a perspective top view of the pallet of FIG. 2A in a locked position.
Figure 3B:
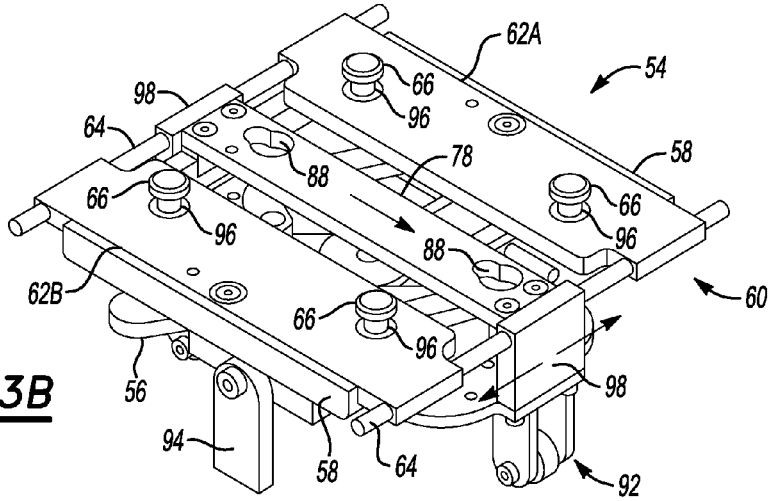
FIG. 3B is a perspective top view of a chassis of the pallet of FIG. 2A.
Figure 3C:
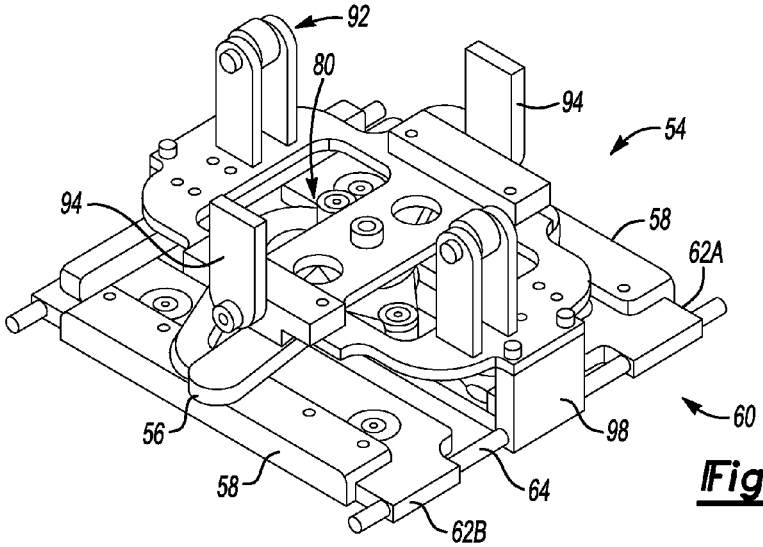
FIG. 3C is a perspective bottom view of the chassis of FIG. 3B.

Referring now to FIGS. 3A-3C, an example configuration of the pallet 50 shown in FIGS. 2A-3C including a chassis 54, a platen apparatus 60, a jaw apparatus 70A and an actuating mechanism 80 is shown in additional detail. The pallet 50 may be configured for quick changeover of the pallet line 30 from producing a first configuration of a bundled group, such as the bundled group 40A to a second configuration of bundled group, such as one or the other of the bundled groups formed by bundling the oriented groups 44B, 44C. For example, the jaw apparatus 70A may be operatively attached to the platen apparatus 60 using a fastening system configured for quick changeover of the jaw apparatus 70A. In the example shown, the fastening system may include a plurality of quick connection fasteners such as releasable locking pins 66. The jaw apparatus 70A may include a plurality of apertures 86 each configured to receive a locking pin 66. Each aperture 86 may be configured to correspond with an aperture 96 defined by the platen apparatus 50 and configured to receive the locking pin 66, such that a locking pin 66 may be inserted through an aperture 86 into a corresponding aperture 96 to quickly attach the jaw apparatus 70A to the platen apparatus 60, and may be quickly detached by removal of the locking pin 66 from the apertures 86, 96. The jaw apparatus 70A and the platen apparatus 60 may include additional quick changeover features to assist in attaching, aligning and/or detaching the jaw apparatus 70A relative to the platen apparatus 60. An alignment indicator (shown as an arrow 52 marked on the jaw element 72B in FIG. 2A, for example) may be provided on the jaw apparatus 70A and/or on the platen apparatus 60 to assist alignment of the apparatus 70A, 60.

The chassis 54 may also be configured for quick changeover, e.g., for quick attachment and detachment of the chassis 54 relative to the pallet conveyor 32. In the example shown, the chassis 54 may include one or more roller elements 92 and one or more guides 94 which may be configured for quick alignment with corresponding features of the pallet conveyor 32. More than one configuration of jaw apparatus 70A, 70B, 70C may be provided, wherein each of the jaw apparatus 70A, 70B, 70C is configured to receive and retain a corresponding oriented group 44A, 44B, 44C (shown in FIGS. 2A-3A, 4A-4B, and 5A-5B respectively). By configuring the jaw apparatus 70A, 70*b*, 70C for quick changeover relative to the platen apparatus 60, the pallet line 30 may be quickly changed over from producing a first configuration of a bundled group to a second type of bundled group, for example, the pallet line 30 may be quickly changed over from forming a bundled group 40A to forming a bundled group 40C by detaching a jaw apparatus 70A from each pallet chassis 54 of the pallet line 30 and attaching a jaw apparatus 70C to each pallet chassis 54 using quick connection fasteners such as locking pins 66. The quick changeover may occur with the pallet chassis 54 attached to the pallet conveyor 32, or the pallets 50 may be detached from the pallet conveyor 32, and the jaw apparatus 70 changed over off-line before reattaching the pallets 50 to the pallet conveyor 32 using the quick changeover attachment features of the chassis 54, which may include the roller element 92 and/or guides 94. A plurality of pallets 50 may be provided as a spare set to facilitate off-line changeover of the jaw apparatus 70 on the pallets 50.

The platen apparatus 60 and the actuating mechanism 80 may be operatively attached to the chassis 54 and be in operative communication with each other. The actuating mechanism 80 is configured to actuate the platen apparatus 60 from a locked condition shown in FIG. 3A to an unlocked condition shown in FIG. 3B, and from the unlocked condition to the locked condition. The actuating mechanism 80 may include an actuator 56, which in the non-limiting example shown is configured as a lever which is movable between a first position shown in FIG. 3A corresponding to the locked condition and a second position shown in FIG. 3B corresponding to the unlocked condition. The actuator 56 may be configured to be selectively movable between the first and second positions by the locking mechanisms 38A, 38B as the pallet 50 is moved in communication with each of the locking mechanisms 38A, 38B during operation of the pallet line 30, such that the locking mechanism 38A, 38B activates the actuator 56 to actuate the actuating mechanism 80 to lock or unlock the pallet 50.

The platen apparatus 60 includes movable platen elements 62A, 62B which are, in the example shown, slidably mounted on platen supports 64. Each of the platen supports are fixedly attached to a platen element 98 which may be configured to operatively attach the platen apparatus 60 to the chassis 54. A fixed platen element 78 is positioned centrally between the movable platen elements 62A, 62B and operatively attached to the chassis 54 via platen elements 98. Each of the movable platen elements 62A, 62B is operatively attached to or in operative communication with the actuating mechanism 80 such that the movable platen elements 62A, 62B may be actuated by the actuating mechanism 80 to move between the closed position shown in FIG. 3A and the open position shown in FIG. 3B, where the movable platen elements 62A, 62B are slidably movable from one position to the other on the platen supports 64, as indicated by the arrows shown in FIGS. 3A-3B. The platen apparatus 60 may include, as shown in FIGS. 3A-3C, one or more stops 58 to limit travel and/or stabilize movement of the platen elements 62A, 62B.

The jaw apparatus 70A includes jaw elements 72A, 72B, which are configured to define a recess 76 therebetween. Each of the jaw elements 72A, 72B may include an plurality of jaw portions 82, 84 operatively attached to each other to form a respective jaw element 72A, 72B. Each jaw portion 82, 84 may at least partially define the recess 76. The recess 76 is configured to receive a portion of an article 42 of an oriented group 44 presented to the pallet 50 by the orientor 16. The recess 76 may be configured to interface with the article 42 received therein to position, stabilize, and/or retain the article 42 in the oriented arrangement relative to other articles 42 in the oriented group 44 received by the pallet 50 with the jaw apparatus 70A in a closed position. Gripping features 74 defined by the jaw elements 72A, 72B are configured to interface with a portion of the article 42 received by the recess 76 when the jaw apparatus 70A is in a closed position to position, stabilize, and/or retain the article 42 in the oriented arrangement relative to other articles 42 in the oriented group 44. In the example shown in FIGS. 2A-3A, the jaw elements 72A, 72B define a recess 76 configured to receive and interface with a head portion 48 of an article 42 provided in the oriented group 44A. The recess 76 may be contoured or shaped to substantially conform to or be in supportive contact with the head portion 48 when the jaw apparatus 70A is in a closed position to position, stabilize and/or retain the article 42 in the oriented arrangement of the oriented group 44A. The gripping features 74 in the example shown may be configured to exert a gripping force on the neck portion 46 of the article 42, to grip and/or retain the article 42 in jaw apparatus 70A with the jaw apparatus 70A actuated to a closed position. The gripping features 74 may be configured to cooperate with the recess 76 to position and/or stabilize the article 42 in the oriented arrangement of the oriented group 44A. The gripping features 74 may be characterized by a surface treatment or texture configured to enhance the gripping capability of the jaw elements 72A, 72B.

Figure 4A:
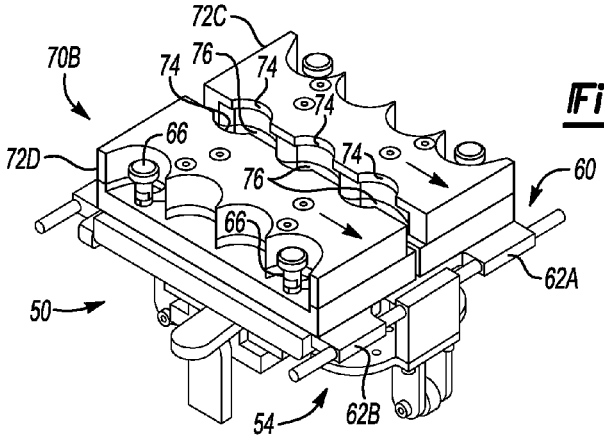
FIG. 4A is a perspective top view illustration of a second configuration of a pallet of the system of FIG. 1.
Figure 4B:
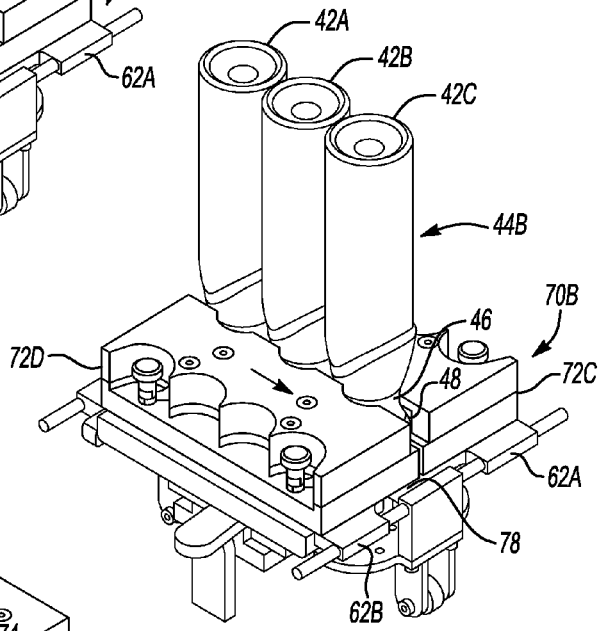
FIG. 4B is a perspective top view illustration of the pallet of FIG. 4A in a locked position and retaining an oriented group.

Referring now to FIGS. 4A and 4B, another example configuration of a jaw apparatus 70B is shown. The jaw apparatus 70B may be configured to receive and retain three articles 42 presented to the pallet 50 as an oriented group 44B. As shown in FIG. 4B, each different type of articles 42A, 42B, 42C may be included in an oriented group 44B, and retained in an oriented arrangement in the jaw apparatus 70B. Referring now to FIGS. 4A-4B and FIG. 1, the oriented group 44B may be formed using the system 10, where, for example, feeding mechanisms 12A, 12B and 12C are configured such that feeding mechanism 12A provides article type 42A to the collator 14, feeding mechanism 12B provides article type 42B, and feeding mechanism 12C provides article type 42C in a coordinated sequence to the collator 14. The collator 14 is configured to collate a plurality of articles including each of article types 42A, 42B and 42C for presentation of the collated articles in grouping order to the orientor 16. The orientor 16 is configured to manipulate and orient the articles 42A, 42B, 42C relative to each other into an oriented arrangement for presentation to a pallet 50 configured to receive the three articles 42A, 42B, 42C in the oriented arrangement. As shown in FIGS. 4A and 4B, the pallet 50 may include a jaw apparatus generally indicated at 70B and including jaw elements 72C, 72D defining a recess 76 configured to receive the oriented group 44B when the jaw apparatus 70B is in an open position, and to continuously retain the oriented group 44B in the oriented arrangement when the jaw apparatus 70B is in a closed position. As previously described, the pallet 50 including the jaw apparatus 70B conveys the oriented group 44B through the sleeving apparatus 18 and bundling apparatus 20 to be sleeved by a wrapping material 26 and bundled to form a bundled group 40 comprising the three articles 42A, 42B, 42C securely bundled in the oriented arrangement defined by the oriented group 44B.

Figure 5A:
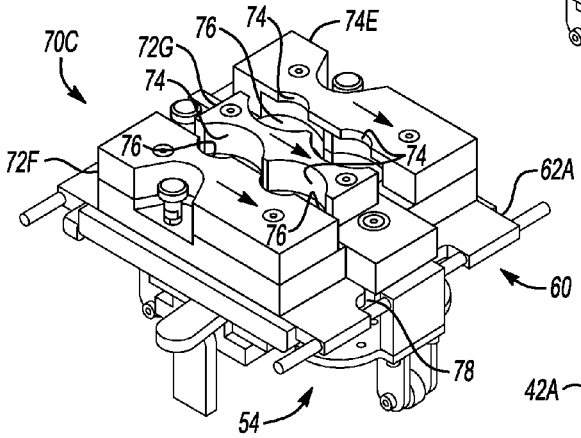
FIG. 5A is a perspective top view illustration of a third configuration of a pallet of the system of FIG. 1.
Figure 5B:
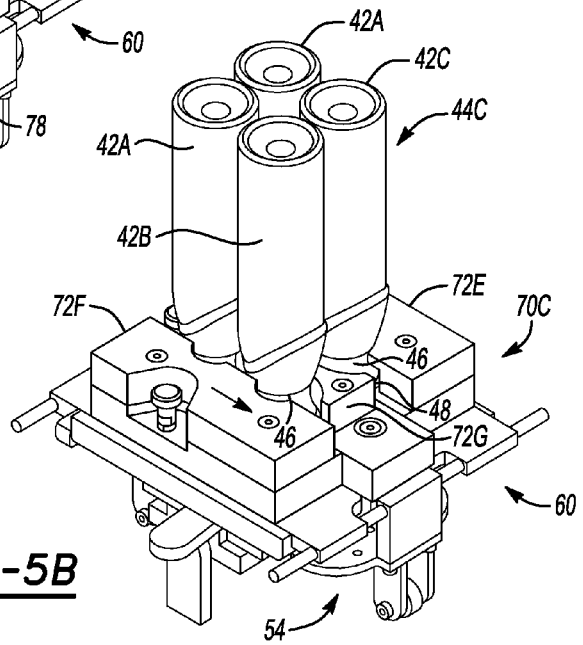
FIG. 5B is a perspective top view illustration of the pallet of FIG. 5A in a locked position and retaining an oriented group.

Referring now to FIGS. 5A and 5B, another example configuration of a jaw apparatus 70C is shown. The jaw apparatus 70C may be configured to receive and retain four articles 42 presented to the pallet 50 as an oriented group 44C. As shown in FIG. 5B, each different type of articles 42A, 42B, 42C may be included in an oriented group 44C in a differing quantities. For example, FIG. 5B shows the oriented group 44C containing a total of four articles 42, including two of a first type of article 42A, and one each of a second and third type of article 42B, 42C, retained in an oriented arrangement in the jaw apparatus 70. Referring now to FIGS. 5A-5B and FIG. 1, the oriented group 44C may be formed using the system 10, where, for example, feeding mechanisms 12A, 12B and 12C are configured such that feeding mechanism 12A provides two of articles 42A, feeding mechanism 12B provides one article 42B, and feeding mechanism 12C provides one article 42C in a coordinated sequence to the collator 14. The collator 14 is configured to collate the two articles 42A with the article 42B and the article 42C, and present the collated articles in grouping order to the orientor 16. The orientor 16 is configured to manipulate and orient the articles 42A, 42B, 42C relative to each other into an oriented arrangement for presentation to a pallet 50 configured to receive the four articles 42A, 42B, 42C in the oriented arrangement. As shown in FIGS. 5A and 5B, the pallet 50 may include a jaw apparatus generally indicated at 70C and including jaw elements 72E, 72F, and 72G which may be operatively attached to the platen apparatus 60 using one or more quick connect fasteners 66, which may be configured for quick changeover of the jaw elements 72E, 72F and 72G. In the example shown, the quick connect fastener 66 may be configured as a releasable locking pins 66 which may interface with apertures 86, 96 to retain the jaw elements 72E, 72F, 72G to the pallet 50. Jaw element 72G is positioned centrally between jaw elements 72E and 72F, and may be configured for quick changeover (attachment/detachment) of the fixed jaw element 72G relative to the platen apparatus 60, and/or adjustable via apertures 88. Jaw elements 72E, 72F are respectively attached to movable platen elements 62A, 62B such that jaw elements 72E and 72F are actuable via the actuating mechanism 80 in operative communication with the movable platen elements 62A, 62B to move between an open position and a closed position relative to the central jaw element 72G. The jaw elements 72E, 72F cooperate with the central jaw element 72G to define recesses 76 configured to receive the oriented group 44C when the jaw apparatus 70C is in an open position, and to continuously retain the oriented group 44C in the oriented arrangement when the jaw apparatus 70C is in a closed position. As previously described, the pallet 50 including the jaw apparatus 70C conveys the oriented group 44C through the sleeving apparatus 18 and bundling apparatus 20 to be sleeved by a wrapping material 26 and bundled to form a bundled group 40 comprising the four articles 42A, 42B, 42C securely bundled in the oriented arrangement defined by the oriented group 44C.

Configurations of the jaw apparatus other than the example configurations 70A, 70B, 70C described herein are possible, and it would be understood that the elements of the system 10 including the pallets 50, infeed mechanism 12, collator 14, orientor 16, wrapping apparatus 16 and bundling apparatus 20 may be configured to form bundled groups 40 of varying configurations, including bundled groups 40 comprising a plurality of articles 42 of a quantity, mix of types, and/or oriented arrangement other than those combinations described herein for purpose of illustrating the system 10 and method of forming a bundled group 40. The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A system for bundling a plurality of articles to form a bundled group, the system comprising:

a pallet configured to:

be actuated from an unlocked to a locked condition and from the locked to the unlocked condition;

in the unlocked condition, receive an oriented group defined by an oriented arrangement of the plurality of articles relative to each other;

in the locked condition, retain the oriented group in the pallet such that the plurality of articles is retained in the oriented arrangement; and invert the oriented group to an inverted position;

present the oriented group in the inverted position for bundling of the plurality of articles using a wrapping material applied via an inverted end of the oriented group to form a bundled group; and wherein the plurality of articles is continuously retained in the oriented arrangement by the pallet during inverting and bundling of the oriented group, such that the bundled group is characterized by the plurality of articles retained in the oriented arrangement by the applied wrapping material.

2. The system of claim 1, wherein:

the wrapping material is a shrinkable wrapping material configured as a sleeve;

the sleeve is applied to the inverted end of the oriented group such that a portion of the sleeve extends from the inverted end of the oriented group;

the pallet is configured to present the oriented group, with the sleeve applied, to a bundling apparatus configured to shrink the sleeve such that the shrunken sleeve conforms to the oriented group to form the bundled group; and such that the portion of the sleeve extending from the inverted end is shrunk to form a base configured to enclose the bottom of the bundled group.

3. The system of claim 1, wherein:

the pallet is configured to be actuated from the locked position to the unlocked position to release the bundled group from the pallet.

4. The system of claim 1, further comprising:

a wrapping apparatus;

wherein:

each of the plurality of articles is retained by the pallet such that a bottom of each of the articles is presented to the wrapping apparatus when the oriented group is inverted by the pallet; and the wrapping apparatus is configured to apply the wrapping material to the inverted oriented group via the bottoms of the articles.

5. The system of claim 1, further comprising:

a bundling apparatus;

wherein:

the wrapping material is a shrinkable wrapping material;

the pallet is configured to present the oriented group in the inverted position and with the shrinkable wrapping material applied to the inverted end to the bundling apparatus; and the bundling apparatus is configured to shrink the shrinkable wrapping material such that the wrapping material after shrinking conforms to the oriented group and forms a base configured to enclose the bottom of the inverted oriented group.

6. The system of claim 1, further comprising:

a pallet line;

wherein:

the pallet is configured to be operatively connected to the pallet line;

the pallet is configured to receive and convey the pallet;

the pallet and the pallet line are configured to cooperate to:

unlock the pallet to receive the oriented group of articles;

lock the pallet to retain the oriented group of articles in the oriented arrangement;

invert the oriented group of articles to the inverted position; and present the oriented group of articles in the inverted position for bundling.

7. The system of claim 1, further comprising:

an orientor configured to:

manipulate the plurality of articles into the oriented arrangement; and present the oriented group of articles to the pallet with the pallet in the unlocked position.

8. The system of claim 7, wherein:

each of the plurality of articles is characterized by an article type; and the oriented group includes a first type article in a first quantity and a second type article in a second quantity;

the system further including a collator in operative communication with the orientor and configured to:

receive first type articles and second type articles; and collate the first type articles and the second type articles to provide the plurality of articles order including the first type article in the first quantity and the second type article in the second quantity to the orientor in grouping order; and the orientor is configured to receive the plurality of articles in grouping order and manipulate the plurality of articles to form the oriented group;

wherein the oriented group includes at least one first type article positioned relative to at least one second type article in the oriented arrangement.

9. The system of claim 1, further including:

a pallet conveyor configured to receive the pallet;

a locking mechanism configured to selectively communicate with the pallet to actuate the pallet from the locked to the unlocked position and from the unlocked to the locked position;

wherein:

the pallet is configured to be movably connected to the pallet conveyor;

the pallet cooperates with a locking mechanism to coordinate unlocking and locking of the pallet with movement of the pallet on the pallet conveyor.

10. The system of claim 1, wherein each article defines a top portion and a bottom, the pallet further comprising:

a jaw apparatus configured to be actuated from one of an open position and a closed position to the other of the open position and the closed position;

wherein the jaw apparatus is configured:

in the open position to receive the top portion of each article of the oriented group in an oriented arrangement;

in the closed position to grip the top portion of each article to retain the oriented group of articles in the pallet in the oriented arrangement;

wherein the pallet is configured to:

invert the retained group of articles in the oriented arrangement such that the bottoms of the group of articles collectively define the inverted end of the oriented group;

present the inverted end for application of the wrapping material to the oriented group via the inverted end.

11. The pallet of claim 10, further comprising:

an actuating mechanism in operative communication with the jaw apparatus;

wherein:

the jaw apparatus includes a first jaw element and a second jaw element which cooperate to define at least one recess therebetween;

the first and second jaw elements are movable relative to each other;

the actuating mechanism is configured to move the first and second jaw elements relative to each other to actuate the jaw apparatus from one of the open and the closed positions to the other of the open and the closed positions;

wherein the at least one recess is configured:

with the jaw apparatus in the open position to receive the top portions of articles presented to the pallet in an oriented arrangement; and with the jaw apparatus in the closed position to retain the articles in the pallet in the oriented arrangement.

12. The pallet of claim 11, wherein:

the jaw apparatus includes a third jaw element located centrally between the first jaw element and the second jaw element; and wherein the first and second jaw elements are each movable relative to the third jaw element to define the at least one recess.

13. The pallet of claim 10, wherein the at least one recess in the closed position defines a gripping feature configured to grip the top portion of each article to retain the group of articles in the pallet in the oriented arrangement.

14. The pallet of claim 10, wherein:

the pallet is configured to be movably connected to a pallet line; and the pallet line is in selective communication with the pallet to actuate the jaw apparatus from one of the open position and the closed position to the other of the open position and the closed position during movement of the pallet by the pallet line.

15. The pallet of claim 10, wherein the jaw apparatus is a first jaw apparatus configured to receive a first group of articles in a first oriented arrangement, the pallet further comprising:

a second jaw apparatus configured to receive a second group of articles in a second oriented arrangement;

a platen apparatus configured to receive a jaw apparatus configured for attachment to the platen apparatus using a quick connect fastener;

wherein the first jaw apparatus and the second jaw apparatus are each configured for attachment to the platen apparatus using the quick connect fastener for quick changeover of the pallet from the first jaw apparatus to the second jaw apparatus.

* * * * *